United States Patent [19]

Adams

[11] 3,940,321

[45] Feb. 24, 1976

[54] METHODS OF TREATING ALUMINIUM

[75] Inventor: Ronald Alfred Charles Adams, Mitcham, England

[73] Assignee: Ozalid Group Holdings Limited, Loughton, Great Britain

[22] Filed: Mar. 21, 1975

[21] Appl. No.: 560,887

[52] U.S. Cl. ..... 204/58; 96/33

[51] Int. Cl.[2] ..... C25D 11/08; C25D 11/12

[58] Field of Search ..... 204/58; 96/33

[56] References Cited

UNITED STATES PATENTS 3,808,000 4/1974 Magnotta et al. ..... 204/58

*Primary Examiner*—Richard L. Andrews

*Attorney, Agent, or Firm*—Stewart and Kolasch, Ltd.

[57] ABSTRACT

A method of treating aluminium, particularly as a means of anodising an aluminium lithographic plate, which method forms an anodised layer which has improved porosity, thickness, abrasion resistance, and chemical inertness but physical adhesion to overcoatings; the method comprises the steps of firstly anodising the aluminium by electrolysis in sulphuric acid solution, and secondly, anodising the aluminium by electrolysis in phosphoric acid solution. The same anodising potential, preferably of 10 to 15 volts d.c. can be used for both steps, which are substantially continuous with one another. The surface is preferably grained first, by electrolysis in dilute hydrochloric acid. Preferred values of specific gravity for the sulphuric and phosphoric acids are given.

10 Claims, No Drawings

METHODS OF TREATING ALUMINIUM

This invention relates to methods of treating aluminium, and more particularly to methods of producing lithographic printing plates of the anodised alumium type, in which a substrate thereof has an anodised aluminium surface. An image on the surface is usually of a colloid, resin or metal, but could be any material which has the property of accepting ink in preference to water. The non-printing areas have an anodised aluminium oxide layer prepared in such manner as to have the property of accepting water in preference to ink.

The use of an anodised aluminium surface for lithographic printing has been known for many years, and many methods of manufacture are known to those skilled in the art. In British Patent No. 716402 (1954), the use of phosphoric acid as an electrolyte for anodising aluminium is mentioned as providing an anodised layer having a high degree of porosity, the porosity providing a means of keying-on an electrodeposit of copper which forms the image area of a lithographic plate. The same patent indicates that the anodised layer provides a water accepting surface for the nonprinting areas which is non-corrodable, because of its porous nature retains water better than a plain metal surface, and has such superior lithographic behaviour that conventional graining as used at that time was unnecessary. The use of sulphuric acid as an electrolyte for anodising aluminium for lithographic plate manufacture has an even longer history.

Although phosphoric acid anodised layers have many desirable features for lithographic use, it is well known that the anodised film is of a rather soft nature and of relatively poor abrasion resistance. This is a disadvantage when long-run printing performance is required. Sulphuric acid anodised layers are much harder, have much greater abrasion resistance and therefore provide more robust lithographic printing plates capable of very long printing runs. They have consequently enjoyed and continue to enjoy considerable commercial success. The sulphuric acid process is also more easily adapted to producing thicker anodised layers than the phosphoric acid process, the latter tending to be self limiting owing to the greater solubility of the anodised film in the electrolyte. However the sulphuric acid process produces layers which are not entirely satisfactory as lithographic substrates in that their receptivity towards ink and water tends to be non-discriminatory and methods of overcoming ink receptivity in the non-printing areas for example have to be used for all but the thinnest of layers. This necessity for "desensitising" the anodised layer can produce a serious problem, for examle when it is required to manufacture pre-sensitised lithographic plates in which the adhesion of the light sensitive coating to the substrate during and after development is all important. When such desensitising treatments are given to the anodised layer (for example by "sealing" or by "subbing") the attainment of satisfactory ink-repellency in the non-printing areas, and at the same time satisfactory performance in the ink-receptive image areas, is a matter of well judged compromise; such treatments can give lithographically desirable results and are in fact well known and in commercial use for both phosphoric acid and sulphuric acid anodised aluminium lithographic printing plates. As a generalisation phosphoric acid anodised layers are somewhat more resistant to the action of lithographic plate etches than sulphuric acid anodised layers and are much less sensitive to undesirable staining by dyes such as may be used or generated in the light sensitive coatings or other solutions which may be applied to the substrate.

The lithographic features of anodised aluminium substrates produced by using sulphuric acid and phosphoric acid electrolytes respectively are thus well known to those skilled in the art, and we have discovered a means whereby the lithographically desirable properties of the two types of anodised layers can be combined, and we have also discovered a means whereby this combination of properties can be achieved in a controllable and efficient manner.

One object of this invention is to provide a novel process for the preparation of an improved anodised aluminium substrate for lithographic printing plates and printing materials.

Another object of this invention is to provide an improved anodised aluminium substrate for lithographic printing plates and printing materials, having an outstanding combination of the desirable properties of chemical inertness to overcoatings, excellent adhesion to sensitised overcoatings, excellent adhesion to printing images, excellent water receptivity and excellent abrasion resistance.

According to this invention, a method of treating aluminium comprises the steps of firstly anodising the aluminium by electrolysis in sulphuric acid solution, and secondly, anodising the said aluminium by electrolysis in phosphoric acid solution.

The aluminium surface can initially be smooth, but is more usually grained by chemical, electrochemical or mechanical or other means, and may be given a rinsing, cleaning or etching treatment immediately before anodising.

For the sulphuric acid process, the electrolyte strength may vary from 5 to 50 percent by volume (s.g. 1.05 – 1.45) of the concentrated acid, and with a typical solution of SG 1.20 an anodising potential of between 10 volts and 15 volts would be used to provide a current density of between 1 and 5 amps/dM$^2$, but wide variations from that have been reported.

The usual anodised layer thickness produced varies from 0.5 to 8.0 microns. It is customary to use direct current and to use lead or stainless steel cathodes (but alternating current can be used although the anodised layers tend to be softer).

The initial anodising treatment can produce a hard and if so desired relatively thick anodised layer which may then be modified by the phosphoric acid anodising treatment to a greater or lesser extent according to the precise lithographic properties required of the substrate. Phosphoric acid anodising for lithographic purposes may be carried out by using an electrolyte strength varying from full strength syrupy phosphoric acid (SG 1.75, 88 percent) down to dilute acid (SG 1.03, 5 percent) although for practical purposes it is usual to use concentrations of between 20 and 60 percent by volume (s.g. 1.11 – 1.43) of the concentrated acid. In order to produce anodic layers of thickness suitable for lithographic plate making in reasonable process times (between 1 minute and 10 minutes), an anodising potential of around 30 volts is customary with current densities of approximately 2.0 amps/dM$^2$, although quite wide variations from these have been reported. The anodised layer thickness produced by the typical phosphoric acid process as outlined above is of the order of 0.25 to 2.0 microns. By prolonging the action of the second anodising treatment it is possible to convert the whole sulphuric acid anodised layer into one typical of phosphoric acid anodising; thus it is possible to obtain an anodised layer having properties ranging from those typical of sulphuric acid anodising to those typical of phosphoric acid anodising.

Providing the two anodising processes are carried out as a substantially continuous operation e.g. with no more than a rinse and a brief interval between the two, we have found that the second anodising treatment can be effected rapidly and with low acid concentrations and low operating potentials. Indeed it is possible to use the same potential for both processes thus simplifying the electrical equipment required. If the sulphuric acid anodised layer is allowed to age prior to its being given the second treatment, the latter is best carried out with a higher electrical potential than is customarily required for sulphuric acid anodising.

Neither the reverse process of anodising initially in a phosphoric acid electrolyte and then with sulphuric acid, nor the use of mixed electrolytes, appear to produce anodised layers and comparable to those produced by the process of this invention, and treatment of sulphuric acid anodised layers by immersion in phosphoric acid solutions in the absence of an applied electrical potential merely leads to partial or complete removal of the anodised layers.

Although the effectiveness of the process has been repeatedly confirmed by practial lithographic plate making and testing on the substrates so produced, we have discovered a very useful and simple test which will demonstrate the attainment of the results claimed for the process of this invention. Such criteria as hardness, thickness and weight per square meter can readily be determined by known methods. Our new test is concerned with the fundamental difference in behaviour between the anodic layer produced with sulphuric acid and that produced with phosphoric acid towards a strongly alkaline solution of potassium hydroxide and zinc oxide in water. Anodised layers produced by the sulphuric acid process dissolve very readily in the zincate etch whereas anodised layers produced by the phosphoric acid process dissolve reluctantly. The reason for this difference is not precisely understood, but is believed to be associated with the barrier layer or residual phosphate within the anodic layer. The zincate solution provides a self indicating end point to the dissolution of the anodic layer because on completion metallic zinc is precipitated onto the bare aluminium surface as a very dark stain. The test is carried out by applying a drop of the solution to the substrate and noting the time taken in seconds for the zinc to precipitate. The end point is usually definite and the reproducibility of the time usually within ± 20 percent. The thickness of the anodic layer has a bearing on the time although not in a linear manner and the results are interpreted in association with the anodised layer thickness. For equal film thicknesses the time for a phosphoric acid anodised layer is of the order of ten times that for a sulphuric acid anodised layer thus the differentiation of the two types of layer is very marked. Typical zincate etch times are:

for a phosphoric acid anodised substrate of 0.5 microns thickness, 200 seconds.

for a sulphuric acid anodised substrate of 0.5 microns thickness, 22 seconds for a sulphuric acid anodised substrate of 4 microns thickness, 45 seconds using a zincate etch of the formula:

| | |
|---|---|
| Water | 500 mls. |
| Potassium Hydroxide | 480 gms. |
| Zinc oxide | 80 gms. |

The following examples are intended to illustrate our inventon but not to limit it in any way.

EXAMPLE I

A sheet of aluminium was degreased in hot dilute sodium hydroxide solution, grained by electrolysis in dilute hydrochloric acid and finally washed thoroughly in de-ionised water. The resultant grained plate was anodised for five minutes in a solution of sulphuric acid of SG 1.25 at room temperature using a lead cathode. The applied electrical potential was 12 volts DC. The plate was rinse thoroughly in de-ionised water and dried at room temperature. Anodised layer thickness and zincate etch solution time was determined.

| | |
|---|---|
| Anodised layer thickness | 4.4 microns |
| Zincate etch time | 45 seconds |

The layer was hard and scratch resistant.

EXAMPLE II

A sheet of aluminium was degreased, grained and washed as in example I and anodised for five minutes in a solution of phosphoric acid of SG 1.33 at room temperature using a stainless steel cathode. The applied electric potential was 12 volts DC. The plate was rinsed thoroughly in de-ionised water and dried.

| | |
|---|---|
| Anodised layer thickness | 0.15 microns |
| Zincate etch time | 145 seconds |

The layer was soft and easily scratched.

EXAMPLE III

The example II was pursued by extending the anodising time progressively. The anodised layer reached a limiting thickness from 15 minutes onwards.

| | |
|---|---|
| The limiting anodised layer thickness | 0.4 microns |
| Zincate etch time | 160 seconds |

The layer was soft and easily scratched.

EXAMPLE IV

A sheet of aluminium was degreased, grained, washed, anodised and rinsed as in example I and then immediately further anodised in a solution of phosphoric acid of SG 1.33 for two minutes at room temperature using a stainless steel cathode, and an electrical potential of 12 volts d.c. The plate was then rinsed thoroughly in de-ionised water and dried.

| | |
|---|---|
| Anodised layer thickness | 4.0 microns |

-continued

| | |
|---|---|
| Zincate etch time | 140 seconds |

Thus we have produced an anodised layer which is substantially as thick as the original sulphuric acid anodised layer but which has the zincate etching characteristics of a thin phosphoric acid anodised layer. The hardness of the layer had been little affected and was still scratch resistant.

EXAMPLE V

The example IV was pursued by extending the time of anodising in phosphoric acid progressively. The final anodised layer reached a limiting thickness after 20 minutes. The resultant anodised layer was identical to that produced in example III.

| Time of phosphoric acid anodising | Anodised Layer Thickness | Zincate Etch Time |
|---|---|---|
| 0 | 4.4 microns | 45 seconds |
| 1 min. | 4.0 microns | 63 seconds |
| 2 mins. | 4.0 microns | 140 seconds |
| 5 mins. | 2.7 microns | 160 seconds |
| 10 mins. | 1.0 microns | 150 seconds |
| 20 mins. | 0.4 microns | 150 seconds |
| 30 mins. | 0.4 microns | 160 seconds |
| 60 mins | 0.4 microns | 150 seconds |

Thus we have converted a hard and thick sulphuric acid anodised layer into a relatively soft and thin layer as produced by phosphoric acid.

EXAMPLE VI

Several sheets of aluminium were cleaned, grained, washed, anodised and rinsed as in example I and then immersed in a solution of phosphoric acid SC 1.33 at room temperature for various times, after which they were removed, rinsed thoroughly in de-ionised water and dried.

| Time of immersion | Anodised Layer Thickness | Zincate Etch Time |
|---|---|---|
| 0 | 4.4 microns | 44 seconds |
| 1 min. | 4.2 microns | 40 seconds |
| 2 mins. | 4.0 microns | 37 seconds |
| 5 mins. | 3.4 microns | 20 seconds |

-continued

| Time of immersion | Anodised Layer Thickness | Zincate Etch Time |
|---|---|---|
| 15 mins. | 1.8 microns | 8 seconds |
| 25 mins. | Zero | 1 second. |

Progressive removal of the anodised layer was recorded and no evidence of the formation of a zincate etch resistant layer typical of phosphoric acid anodising was noted. In fact, as the removal of the layer progressed, the residual layer appeared to be much more quickly soluble in the zincate etch than a layer of equivalent thickness produced by directly anodising in sulphuric acid. This was probably due to the progressive disruption of the anodised layer caused by the action of the phosphoric acid.

I claim:

1. A method of treating aluminium, the method comprising the steps of first anodising the aluminium by electrolysis in sulphuric acid solution, then secondly anodising the said aluminium by electrolysis in phosphoric acid solution.

2. A method according to claim 1 in which an electrical potential of between 10 and 15 volts d.c. is used for at least one of said anodising steps.

3. A method according to claim 1 in which the same electrical potential is used for the two anodising processes.

4. A method according to claim 1 in which the two anodising processes are substantially continuous, being separated by only a rinse, and a brief interval.

5. A method according to claim 1 in which the sulphuric acid solution has a specific gravity of between 1.05 and 1.45.

6. A method according to claim 1 in which the specific gravity of the sulphuric acid solution is in the range 1.2 to 1.25.

7. A method according to claim 1 in which a surface of the aluminium is grained before the said anodising.

8. A method according to claim 7 in which the graining is by electrolysis in dilute hydrochloric acid solution.

9. A method according to claim 1 in which the phosphoric acid solution has a specific gravity of between 1.11 and 1.43.

10. A method according to claim 1 in which the current density during the first anodising is between 1 and 5 amps/sq.dm.

* * * * *